US010954029B2

(12) United States Patent
Etem et al.

(10) Patent No.: US 10,954,029 B2
(45) **Date of Patent: *Mar. 23, 2021**

(54) FLAT-FOLDING BOX COVERS AND METHOD OF ASSEMBLY AND METHODS OF CUSTOMIZING IMAGES ON THE BOX COVER

(71) Applicants: Jeanne Helen Etem, Chanhassen, MN (US); Julie Moore Etem, Chanhassen, MN (US); Sherrie Lea Sullivan, Hopkins, MN (US)

(72) Inventors: Jeanne Helen Etem, Chanhassen, MN (US); Julie Moore Etem, Chanhassen, MN (US); Sherrie Lea Sullivan, Hopkins, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/520,106

(22) Filed: Jul. 23, 2019

(65) Prior Publication Data

US 2020/0010232 A1 Jan. 9, 2020

Related U.S. Application Data

(63) Continuation of application No. 15/603,504, filed on May 24, 2017, now abandoned, which is a continuation-in-part of application No. 15/083,326, filed on Mar. 29, 2016, now Pat. No. 10,364,060, which is a continuation-in-part of application No. 14/961,427, filed on Dec. 7, 2015, now abandoned.

(Continued)

(51) Int. Cl.

| | |
|---|---|
| ***B65D 5/42*** | (2006.01) |
| ***B65D 5/62*** | (2006.01) |
| ***A47K 10/32*** | (2006.01) |

(52) U.S. Cl.

CPC ..... *B65D 5/425* (2013.01); *B65D 5/62* (2013.01); *A47K 2010/3233* (2013.01); *B65D 2313/04* (2013.01)

(58) Field of Classification Search

CPC ..... B65D 2313/04; B65D 5/425; B65D 5/62; A47K 10/421

USPC ..... 229/125.05, 125.15; 221/305; 206/233, 206/395

See application file for complete search history.

(56) References Cited

U.S. PATENT DOCUMENTS 3,064,876 A 11/1962 Warner
3,591,071 A 7/1971 Rosenberg (Continued)

*Primary Examiner* — Christopher R Demeree

(74) *Attorney, Agent, or Firm* — Haugen Law Firm PLLP

(57) ABSTRACT

Variations for flat-folding box covers with four distinct design configurations: one piece; two piece; flat-folding structural frames and clear, rigid box covers with decorative inserts.

Figures 1A, 2A:
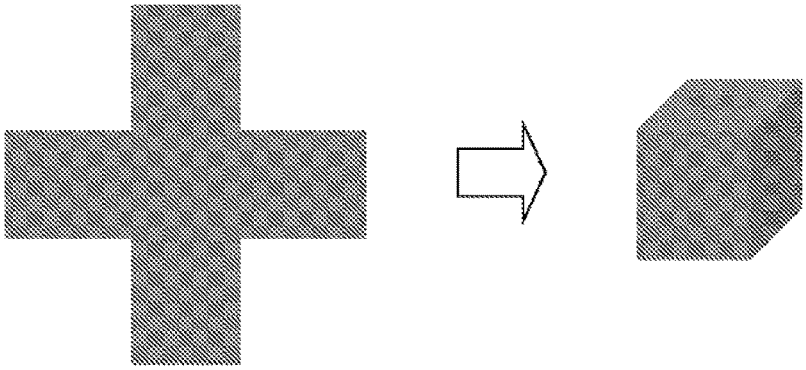

Construction techniques comprise a variety of methods including use of cutout stock sheet materials; use of stiffening panels; use of structural frame elements; use of lamination; use of clear plastic panels; and the use of coatings. Fastening techniques comprise a variety of methods including; magnets, snaps, structural frames, hinges, and adhesives. The end user may purchase finished box covers or components or select from a set of design options offered by a manufacturer; or supply custom decorative images to a manufacturer to apply to the box cover; or purchase a kit in order to make or embellish a box cover themselves. Some designs allow for the end user to update and reconfigure the design elements of the box cover after it is purchased.

15 Claims, 6 Drawing Sheets

Related U.S. Application Data

(60) Provisional application No. 62/342,352, filed on May 27, 2016, provisional application No. 62/088,657, filed on Dec. 7, 2014.

(56) References Cited

U.S. PATENT DOCUMENTS 3,918,631 A 11/1975 Hackenberg
3,979,019 A 9/1976 Bliss
5,140,562 A 8/1992 Moore-Ede
5,145,062 A 9/1992 Crispi
5,258,247 A 11/1993 Platzer
5,497,876 A 3/1996 Fleming
5,639,523 A 6/1997 Ellis
D390,391 S 2/1998 Hsu
5,961,034 A 10/1999 DeMunnik et al.
6,419,114 B1 * 7/2002 Lenz ..... B65D 83/0805 221/47
D491,059 S * 6/2004 Kim ..... D9/416
D494,859 S 8/2004 Keberlein
6,884,081 B1 4/2005 Ovadia
D514,928 S 2/2006 Keberlein
7,665,628 B1 2/2010 Milligan
7,699,214 B2 * 4/2010 Mestre ..... B65D 5/549 229/232
7,737,391 B2 6/2010 Long
D629,634 S 12/2010 Hicks et al.
8,602,258 B2 12/2013 Long
8,646,971 B2 * 2/2014 Doyle ..... B65D 33/24 383/38
D776,954 S * 1/2017 Falkner ..... D6/519
2002/0037038 A1 6/2002 Tran
2002/0067038 A1 * 6/2002 Tran ..... B65D 5/425 281/29
2003/0205613 A1 11/2003 Schliebner et al.
2006/0049067 A1 3/2006 McDonald
2007/0063007 A1 3/2007 Campbell
2009/0212096 A1 8/2009 Sieber et al.
2010/0275553 A1 11/2010 Weder
2012/0283084 A1 11/2012 Cheich
2013/0051705 A1 2/2013 Amoroso
2013/0097834 A1 4/2013 Pacione et al.
2014/0027500 A1 1/2014 Thorn et al.
2015/0335117 A1 * 11/2015 Juillet ..... B65D 5/02 206/6.1

* cited by examiner

FLAT-FOLDING BOX COVERS AND METHOD OF ASSEMBLY AND METHODS OF CUSTOMIZING IMAGES ON THE BOX COVER

CROSS-REFERENCE TO RELATED APPLICATIONS

This application is a continuation of U.S. patent application Ser. No. 15/603,504, filed on May 24, 2017 and entitled "Flat-Folding Box Covers and Method of Assembly and Methods of Customizing Images on the Box Cover", which itself claims the benefit of U.S. Provisional Patent application Ser. No. 62/342,352, filed May 27, 2016 and entitled "Flat-Folding Box Covers and Methods of Assembly and Methods of Customizing Images on the Box Cover", and further is a continuation-in-part of U.S. patent application Ser. No. 15/083,326, filed on Mar. 29, 2016 and entitled "Flat-Folding Box Covers", which itself is a continuation-in-part of U.S. patent application Ser. No. 14/961,427, filed on Dec. 7, 2015 and entitled "Flat-Folding Decorative Tissue Box Covers and Related Methods, Systems, and Software", which itself claims the benefit of U.S. Provisional Patent application Ser. No. 62/088,657, filed on Dec. 7, 2014 and entitled "Flat-Folding Decorative Tissue Box Covers and Related Methods, Systems, and Software", the contents of each of which being incorporated herein in their entirety.

BACKGROUND

Most Pertinent Prior Art Patents

| Number | Patent Holder | Date |
|---|---|---|
| U.S. Pat. No. 3,918,631 A | Robert Hackenberg | 1971-07- |
| U.S. Pat. No. 3,591,071 A | Charles W. Rosenberg | 1971-07- |
| U.S. Pat. No. 3,979,019 A | Robert A Bliss | 1976-09- |
| U.S. Pat. No. 3,064,876 A | R. E. Warner | 1962 Nov. 20 |
| U.S. Pat. No. 5,258,247 A | Scott J. W. Platzer | 1993-11- |
| U.S. Pat. No. 7,665,628 BI | Loren Milligan | 2010 Feb. 23 |
| US D390391 | Junior Julian Hau | 1998 Feb. 10 |
| US D494859 | Gerald J. Keberlein | 2004-08- |
| US D514928 | Gerald J. Keberlein | 2006-02- |

Most Pertinent Prior Art Patent Applications

| | | |
|---|---|---|
| US 2002/0067038 Al | Lam H/Tran | 2002 Jun. 1 |

FIELD OF THE INVENTION

The present invention relates generally to flat-folding box covers, with specific emphasis on tissue box covers.

Background of the Invention Field

Facial tissues are typically purchased in light cardboard boxes of standard sizes which serve as both the package and the dispenser. These standard tissue boxes may be plain or have decorative designs. They may display the brand name of the manufacturer. The boxes are designed for limited use and are disposed of once all the tissues they contain are gone.

Decorative tissue box covers are designed to be placed over standard tissue boxes in order to conceal the utilitarian nature of the tissue boxes and to provide a more attractive appearance. Versions are available to fit over the standard tissue box size formats which are mainly rectangular or cubical. These decorative tissue box covers have several drawbacks in that they are rigid, they do not fold and they are often heavy. They cannot be readily customized, and their bulk makes them expensive to ship. Box covers that don't fold and are rigid are evidenced in design patents D390391, D494859 and D514928.

The present inventors saw three specific issues they wanted to address in decorative tissue box covers. First, the need for a lightweight, reusable box cover that could be shipped and stored in a flat state; then assembled into a box shape for use; second, the need for a durable, reusable box cover that would not be damaged when assembled and disassembled so it would have a long life and third, a design that would allow users to customize the box cover with their own designs.

DISCUSSION OF PRIOR ART

There are many patents related to tissue boxes and tissue box covers, many deal with disposing of waste tissues, or raising the floor of the box up as tissues are dispensed. Listed next is a description of each patent.

U.S. Pat. No. 3,918,631. This is a flat-folding box which is on a sheet with flaps that are inserted into each other. The top lifts up rather than having an open aperture.

U.S. Pat. No. 3,591,071. This is a carton with several tuck-in flaps. The top lifts up rather than having an open aperture.

U.S. Pat. No. 3,979,019. This is a carton for use in dispensing tissues having a specialized closure. It has several tuck-in flaps that fold over the opening but also have flaps that hold the box together.

U.S. Pat. No. 3,064,876. This package is for gift boxes but it discusses the use of custom decorations. It has tuck-in flaps and a cover.

U.S. Pat. No. 5,258,247. The patent relates to a concept of transparent covering over a box for strength and stability. This cover is sealed to the object.

U.S. Pat. No. 7,665,628. This is a rigid two piece tissue dispenser with a top and a base. The base has a mechanism for lifting up as tissues are dispensed.

US 2002/0067038 A1. This is a rigid box. It has bubble enclosures for holding ornamental pictures.

SUMMARY OF THE INVENTION

This provisional application is for a variety of embodiments of a flat-folding box cover and method of assembly.

The purpose of this invention is to provide a flat-folding box cover as a replacement for a rigid box cover that I) has a long life due to its rugged construction; 2) has strong decorative appeal and 3) can be customized with end user selected images.

There are four basic starting design variations, all of which have many potential design options:

I) One piece designs
2) Two piece designs
3) Flat-folding structural frame designs
4) Clear, rigid box cover with decorative insert

DESCRIPTIONS OF FIGURES

FIGS. 1A-1E. Assembled flat-folding box cover with four side panels and a top panel with aperture.

FIGS. 2A-2F. Flat-folding box cover form with four side panels and atop panel with aperture. The form may have decorative images, embellishments, coatings or lamination.

Figures 1B, 2B, 3:
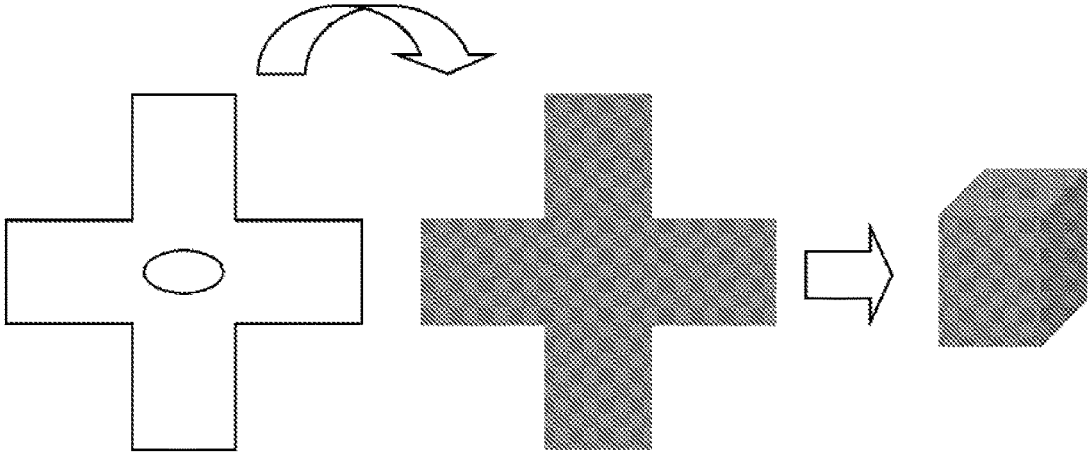

FIG. 3. Flat-folding clear plastic box cover form that fits over the decorative flat-folding box cover form.

Figures 1C, 2C, 4:
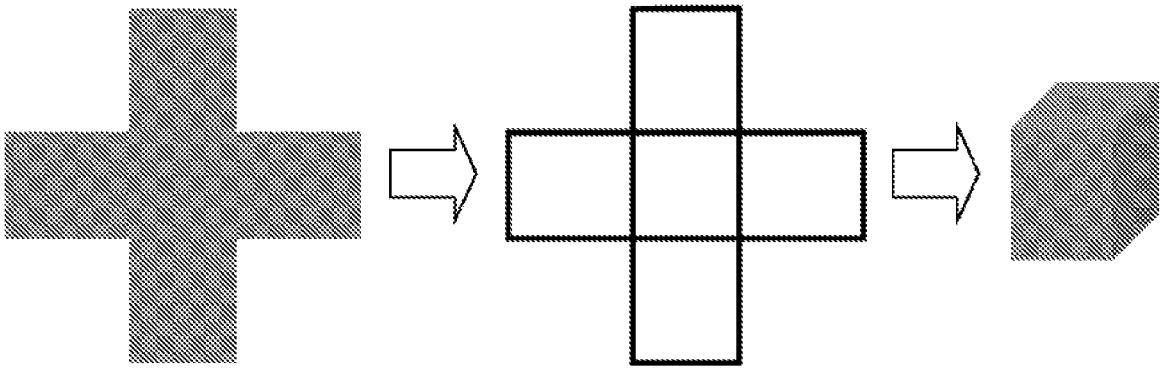

FIG. 4. Flat-folding cover frame showing the rails of each side and top panel.

Figures 1D, 2D, 5:
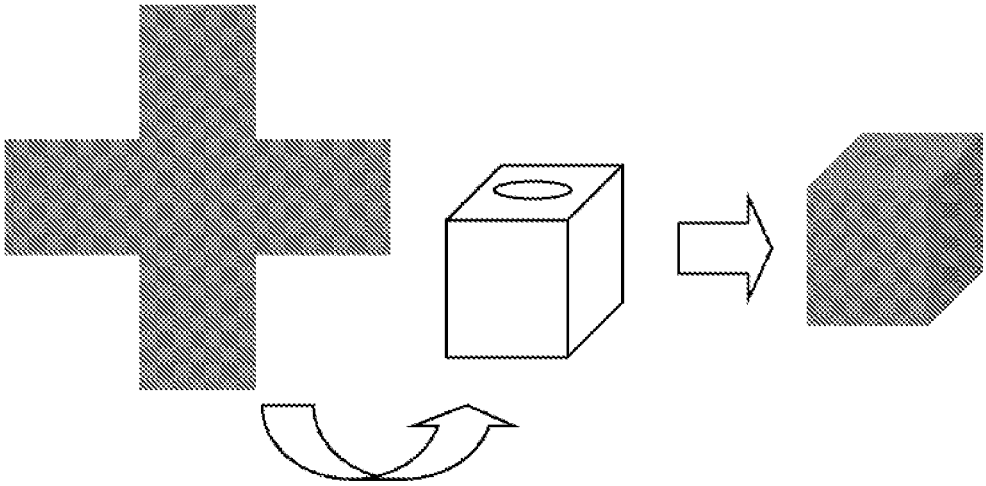

FIG. 5. Transparent body into which a flat-folding decorative insert is installed.

Figure 6:
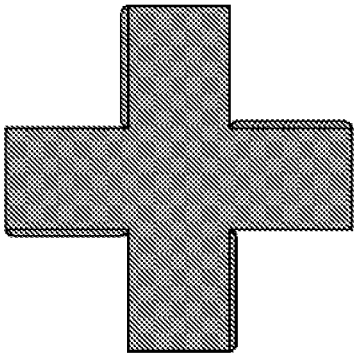

FIG. 6. Flat-folding box cover form with four side panels and a top panel and flaps on one edge of the side panels for fastening the box cover together.

Figure 7:
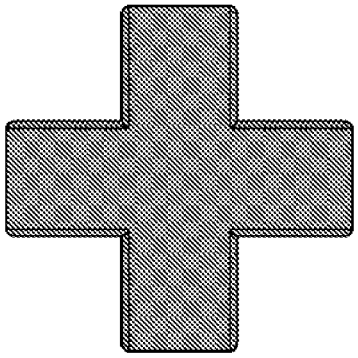

FIG. 7. Flat-folding box cover form with four side panels and a top panel and flaps on both edges of the side panels for fastening the box cover together.

Figure 8:
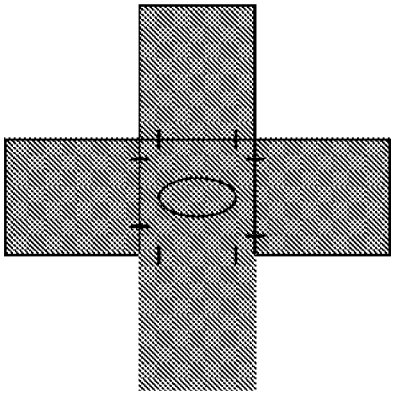

FIG. 8. Flat-folding box cover form with four side panels and a top panel with aperture with bendable hinges between the top and each side panel.

Figure 9:
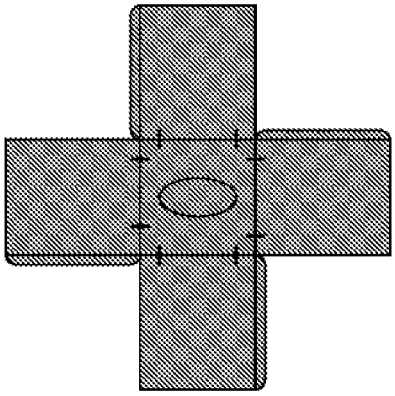

FIG. 9. Flat-folding box cover form with four side panels and a top panel with aperture with bendable hinges between the top and side panels. The flat-folding box cover form has flaps on one edge of each side panel.

Figures 10, 11, 12, 13:
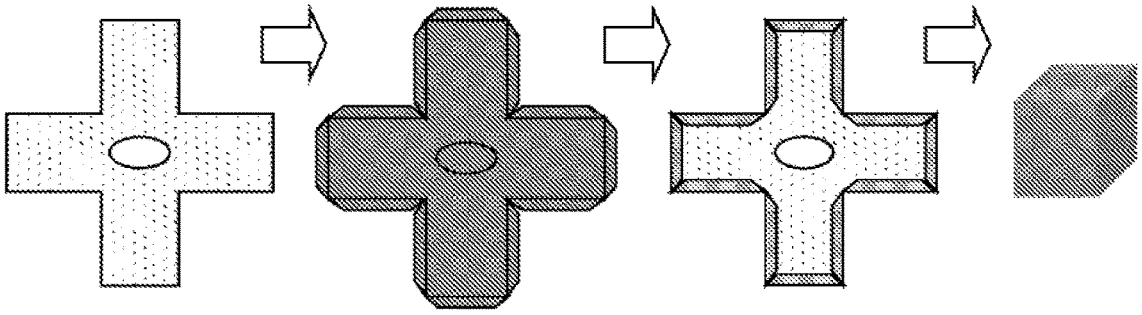

FIG. 10. Flat-folding box cover form with four side panels and a top panel with aperture used as a base layer to which a decorative layer is attached.

FIG. 11. Decorative flat-folding box cover layer with four side panels and a top panel with aperture that can be attached to a flat-folding box cover form. The decorative layer may be paper, cardstock, fabric or other material.

FIG. 12. Decorative flat-folding box cover layer attached to the flat-folding box cover form.

FIG. 13. Assembled flat-folding box cover with a decorative layer over the flat-folding box cover form.

Figures 14, 15, 16, 17:
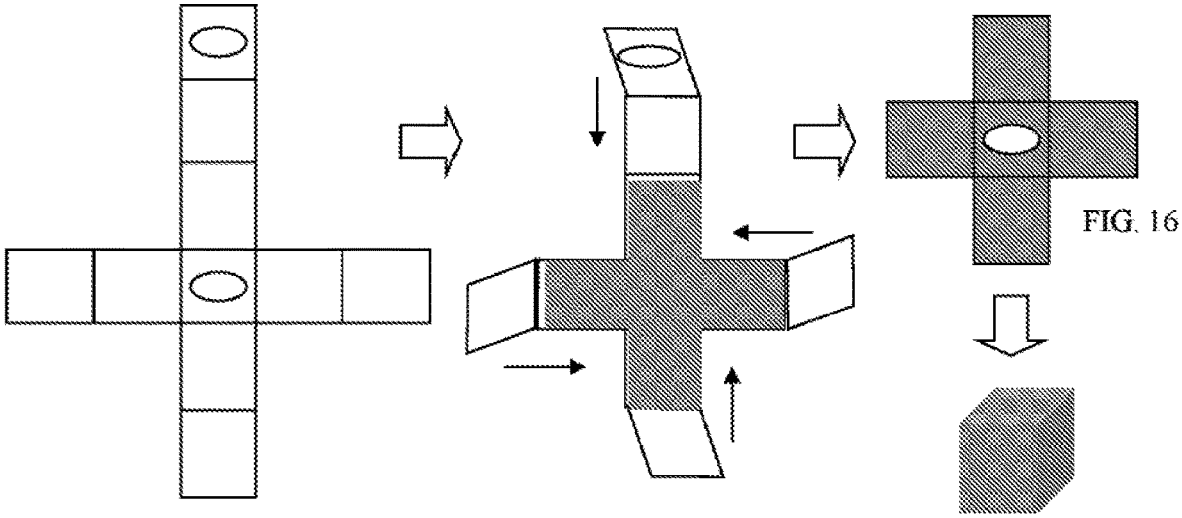

FIG. 14. Flat-folding clear plastic box cover form with additional side panels.

FIG. 15. Flat-folding clear plastic box cover form folded to encase a decorative flat-folding box cover form.

FIG. 16. Assembled flat-folding clear plastic box cover form folded to encase a decorative flat-folding box cover form.

FIG. 17. Assembled flat-folding clear plastic box cover with decorations covering a flat-folding box cover form.

Figures 2, 18, 19:
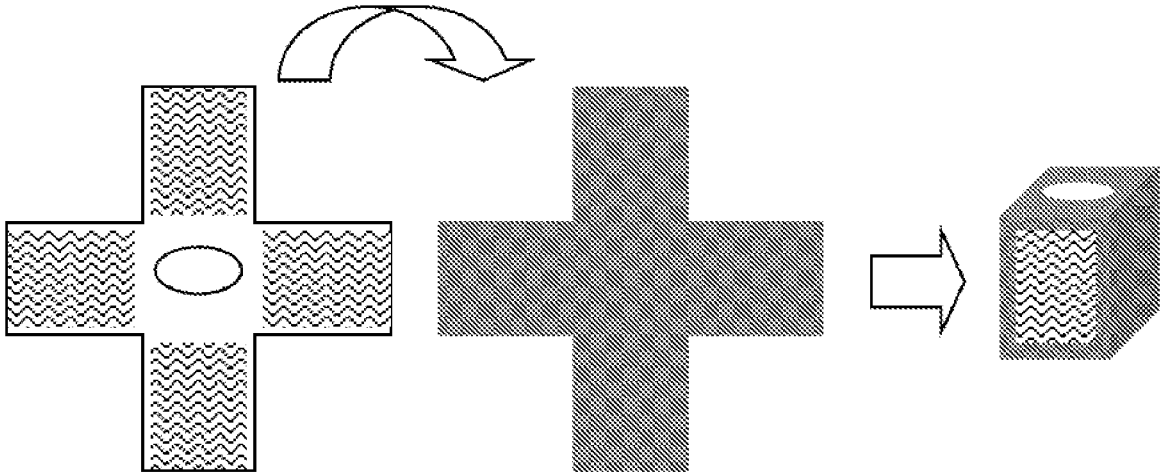

FIG. 18. Assembled flat-folding structural frame for a box cover with individual decorations on each side of the structural frame.

FIG. 19 Tissue box cover assembled with individual decorations or pictures on each side of the box.

Figures 20, 21, 22:
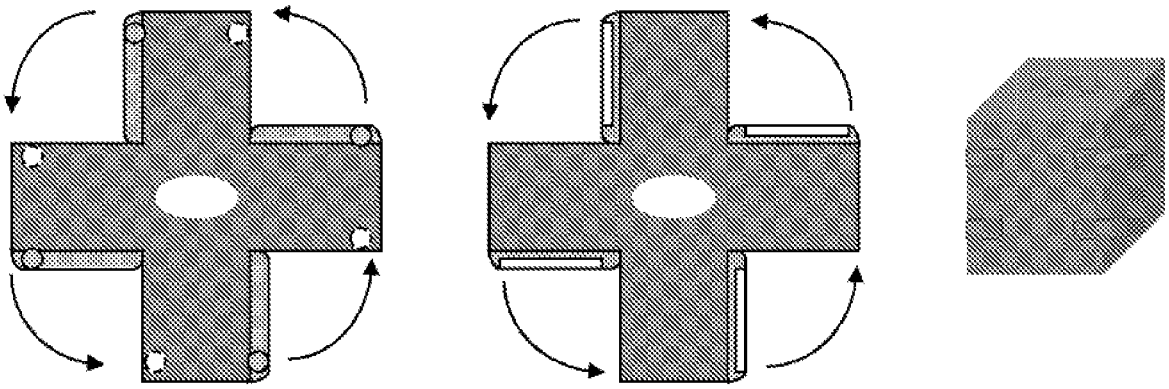

FIG. 20. Flat-folding box cover form with four side panels and a top panel with aperture, with one flap on each side panel. Pairs of snaps with corresponding mates on the flap and the adjacent side panel act as the closure mechanism.

FIG. 21. Flat-folding box cover form with four side panels and a top panel with aperture with one flap on each side panel. An adhesive strip on the flap acts as the closure mechanism.

FIG. 22. Assembled flat-folding box cover form with four side panels and a top panel with aperture with clear tape or labels acting as the closure mechanism.

Figures 1E, 23A, 23B:
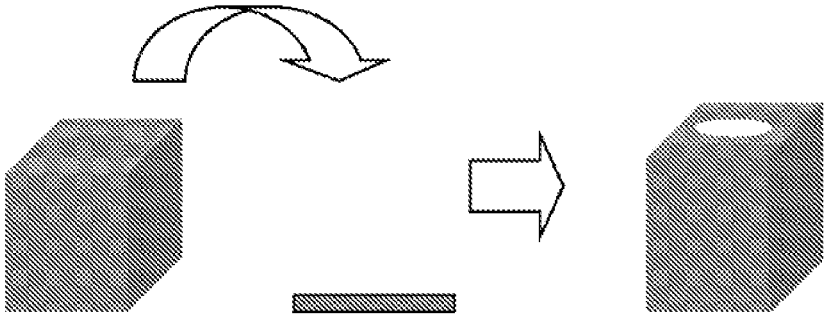

FIG. 23A. Tray or base to hold the assembled flat-folding box cover.

FIG. 23B. Assembled flat-folding box cover supported by a tray or base.

Figure 24A:
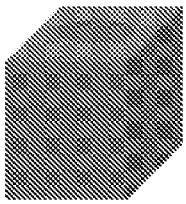

FIG. 24A. Assembled flat-folding box cover form with four side panels and a top panel with aperture and a decorative ring around the aperture 23.

Figure 24B:
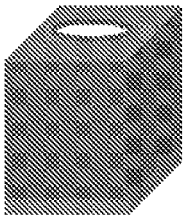

FIG. 24B Assembled flat-folding box cover supported by a tray or base.

DETAILED DESCRIPTION

One Piece Basic Design

FIG. 1A is an assembled box cover which is made by folding a decorative flat-folding box cover form FIG. 2A into a box cover. FIG. 2A is a decorative flat-folding box cover form with either standard or custom images or embellishments. It may be comprised of a single layer or several layers and coatings, but they are joined either permanently or temporarily and so are considered to be one integrated piece.

Two Piece Basic Design

FIG. 3 is a flat-folding clear plastic box cover form that fits over a decorative flat-folding box cover form FIG. 2B. FIG. 1B shows an assembled box cover. The flat-folding clear plastic box cover form FIG. 3 and the decorative flat-folding box cover form FIG. 2B are not permanently joined and so are considered to be two separate pieces. The flat-folding clear plastic box cover form FIG. 3 may be removed.

Flat-Folding Structural Frame Basic Design

FIG. 4 is a flat-folding structural frame to which a decorative flat-folding box cover form FIG. 2C may be attached. An assembled box cover is shown in FIG. 1C.

One-Piece Design Variations—Layout

Figure 2E:
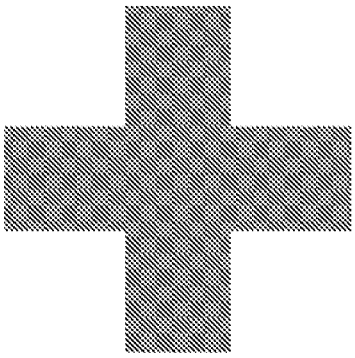

FIG. 2E is the basic flat-folding box cover form. FIG. 6 is the basic flat-folding box cover form with flaps on one edge of the side panels and FIG. 7 is the basic flat-folding box cover form with flaps on both edges of the side panels. The flaps are used to hold closure mechanisms and also to create a finished look along the seams.

One-Piece Design Variations—Folding Mechanism

FIG. 8 is a flat-folding box cover from with bendable hinges connecting the top panel and the side panels. The bendable hinges facilitate the box cover retaining its shape when assembled. FIG. 9 is a flat-folding box cover form with bendable hinges and side flaps.

One-Piece Design Variations—Wrapped

FIG. 10 is a flat-folding box cover. FIG. 11 is a flat-folding box cover decorative layer with additional flaps extending from the edges. FIG. 12 shows how the decorative layer FIG. 11 may be wrapped around the form FIG. 10 and the flaps secured to create a wrapped box cover form. FIG. 13 shows the assembled box cover. The decorative layer FIG. 11 may be fabric or paper or other material and may be either permanently affixed to the base form FIG. 10 or it may be removable.

Two-Piece Design Variations—Layout

FIG. 15 is a depiction of a clear plastic flat-folding box cover form with additional flaps that are designed to encase a decorative layer. FIG. 16 is an illustration of how the clear plastic flat-folding box cover form has been folded around a decorative flat-folding box cover form FIG. 2A. FIG. 17 shows an assembled boxcover.

Two-Piece Design Variations—Placement of Design Elements

FIG. 18 is a plastic flat-folding box cover form which has decorative elements affixed and is designed to go over a plain or decorative flat-folding box cover form FIG. 2F. An assembled box cover is shown in FIG. 19.

Closure Mechanism Variations

FIG. 20 shows the flat-folding box cover form with flaps on one edge of the side panels with pairs of snaps on the flaps and the adjacent side panels. FIG. 21 shows how the flat-folding box cover form with flaps on one edge can be assembled by putting adhesive on the flaps. FIG. 22 shows an assembled box cover with clear tape on the outside of the box cover holding it together. Other closure mechanisms may be employed and include, but are not limited to: snaps, magnets, tape, adhesives, glue dots, adhesive strips and labels, hook & loop, button & string, button & hook, snap-fit joints etc. Closures may be on either the inside or the outside of the box or neither or both. Closures may be on either the decorative layer or the clear plastic layer or neither or both.

Additional Options

FIG. 1E is an assembled box cover. FIG. 23A is a base or tray for holding FIG. 1E. The tray or base FIG. 23 may serve as a decorative element, as protection for the box cover or it may serve as a closure mechanism for the assembled box cover. A tray or base FIG. 23A may have slots to hold the side panels of the box cover in place. Any of the design variations may use a tray or base.

FIG. 24A is an assembled box cover with a decorative ring around the aperture. This option is available for all variations of the box cover.

Additional Options for Customizing the Box, Both for Other Applications and to Allow End-Users to Use their Own Images The box cover can be configured to cover all standard tissue box sizes and configured to go into other box shapes. Box covers can be configured to fit over dispensers for paper hand towels, moist hand wipes, cosmetic wipes, baby wipes etc.

In additional embodiments, the decorative designs might be furnished by the end user either to the manufacturer or the selling entity for use as decoration for either or both top panels and side panels.

In additional embodiments, the end user may select to customize some aspects of the configuration by choosing from a set of design options provided by a seller.

In additional embodiments the plastic overlay might have slots where photos or other items could be inserted by the eventual purchaser.

In some additional embodiments the flat-folding box cover will be produced in a kit format. Some of the potential kit embodiments are:

a. The kit may be an undecorated flat-folding box cover. The consumer would supply the embellishments.

b. The kit may be a partial set of components. The consumer may need to purchase additional items in order to complete a flat-folding box cover.

c. The kit may be all inclusive with everything needed to make a flat-folding box cover and may include, but is not limited to: decorative layers, lining layers, coating/protective layers, panels, stiffeners, fasteners, decorative ring, adhesives, and embellishments. The kit may contain the actual components or the patterns from which components may be created.

d. The kit may include software to create embellishments.

e. The kit may specify links to websites where embellishments may be created, purchased or downloaded.

We claim:

1. A decorative apparatus, comprising;

a body having a transparent wall at least in part defining a cavity;

a decorative insert for placement in the cavity in a position visible through the transparent wall, said decorative insert including a planar preform having a top panel and a plurality of side panels articulated to the top panel, each side panel having a top edge connected to the top panel and first and second side edges extending from the top edge, wherein said side panels may be moved with respect to the top panel between a planar condition and a non-planar condition, wherein the first side edge of each side panel is spaced from the second side edge of an adjacent one of the side panels when in the planar condition, and wherein the side panels are movable so that the first side edge of each side panel is adjacent to the second side edge of an adjacent one of the side panels.

2. The decorative apparatus as in claim 1 wherein said substantially planar preform has a cruciform shape.

3. The decorative apparatus as in claim 2, including four side panels each articulated to a respective hinge edge of the top panel.

4. The decorative apparatus as in claim 3 wherein the first and second side edges are substantially parallel to one another.

5. The decorative apparatus as in claim 1 wherein the side panels are movable at least to perpendicular with respect to said top panel.

6. The decorative apparatus as in claim 5 wherein the side panels are adjacent to one another when perpendicular with respect to top panel.

7. The decorative apparatus as in claim 1, including an aperture in the top panel.

8. The decorative apparatus as in claim 7 wherein said body includes a second aperture that aligns with said first aperture when said decorative insert is installed into the cavity.

9. The decorative apparatus as in claim 1 wherein said body comprises a cover for placement over an object.

10. The decorative apparatus as in claim 9 wherein the object is receivable in the cavity.

11. The decorative apparatus as in claim 10 wherein said body comprises a transparent plastic or glass.

12. A decorative cover apparatus, comprising:

an articulatable frame adjustable between a planar condition and a non-planar condition, said frame having a top member and a plurality of side members articulated to the top member, each side member having first and second side rails extending from the top member, wherein the side members are movable so that the side rail of each side member is adjacent to the second side rail of an adjacent one of the side members; and a decorative preform for connection to said articulatable frame, said decorative preform having a top panel and a plurality of side panels articulated to the top panel, each side panel having a top edge connected to the top panel, and first and second side edges extending from the top edge, wherein the side panels are movable so that the first side edge of each side panel is adjacent to the second side edge of an adjacent one of the side panels.

13. The decorative cover apparatus as in claim 12 wherein said first and second side rails of each of said side members are connectable to respective first and second side edges of said side panels.

14. The decorative cover apparatus as in claim 12 including an aperture in the top panel.

15. The decorative cover apparatus as in claim 12 wherein said side panels may be moved with respect to the top panel between a planar condition and a non-planar condition.

* * * * *